US006419048B1

(12) United States Patent
Robinson et al.

(10) Patent No.: US 6,419,048 B1
(45) Date of Patent: Jul. 16, 2002

(54) ADJUSTABLE SUPPORTS

(75) Inventors: Laurence Robinson, 85 Taybridge Road, London SW11 5PX; Graham Lacy, London, both of (GB)

(73) Assignee: Laurence Robinson, London (GB)

( * ) Notice: Subject to any disclaimer, the term of this patent is extended or adjusted under 35 U.S.C. 154(b) by 0 days.

(21) Appl. No.: 09/563,851

(22) Filed: May 4, 2000

(51) Int. Cl.[7] ..... E04G 1/00

(52) U.S. Cl. ..... 182/182.1; 182/181.1; 182/183; 182/186; 182/226

(58) Field of Search ..... 182/153, 155, 182/181.1, 183, 186.1, 186.2, 186.3, 186.4, 186.5, 186.6, 186.7, 186.8, 186.9, 182.1, 182.2, 182.3, 182.4, 182.5, 226, 227

(56) References Cited

U.S. PATENT DOCUMENTS

| | | | | | |
|---|---|---|---|---|---|
| 643,969 | A | * | 2/1900 | Milne | 182/182.3 |
| 2,419,778 | A | * | 4/1947 | Imes | 182/182.3 X |
| 2,636,785 | A | * | 4/1953 | Albrecht et al. | 182/182.1 X |
| 2,803,502 | A | * | 8/1957 | Ellinger | 182/226 |
| 3,349,869 | A | * | 10/1967 | Evans | 182/226 |
| 3,554,474 | A | * | 1/1971 | Davies | 248/49 |
| 3,830,340 | A | * | 8/1974 | Schaffel | 182/226 |
| 3,887,036 | A | * | 6/1975 | Telban | 182/226 X |
| 3,934,676 | A | | 1/1976 | Rice | |
| 3,941,209 | A | * | 3/1976 | Adams | 182/186 |
| 3,995,716 | A | * | 12/1976 | Bond | 182/226 X |
| 4,030,565 | A | | 6/1977 | Chaput | |
| 4,135,691 | A | * | 1/1979 | Wiesmann | 248/188.6 |
| 4,496,028 | A | * | 1/1985 | Peterson | 182/186 |
| 4,506,761 | A | | 3/1985 | Brown | |
| 5,865,269 | A | * | 2/1999 | Eskesen | 182/182.2 X |

FOREIGN PATENT DOCUMENTS

| | | |
|---|---|---|
| GB | 632047 | 11/1949 |
| GB | 2213714 | 8/1989 |
| GB | 2330767 | 5/1999 |

* cited by examiner

*Primary Examiner*—Bruce A. Lev
(74) *Attorney, Agent, or Firm*—Leydig, Voit & Mayer, Ltd.

(57) ABSTRACT

A trestle comprises two pairs of legs which can be opened and closed relative to one another. A beam has two depending poles and each pole is clamped by a clamping mechanism carried by an associated pair of legs. When the legs are open, the clamping mechanism is operative to hold the associated pole against movement relative to the associated legs whereas when the legs are moved together, this releases the clamping mechanism and allows the position of the pole to be adjusted.

14 Claims, 6 Drawing Sheets

ADJUSTABLE SUPPORTS

BACKGROUND TO THE INVENTION

1. Field of the Invention

The invention relates to adjustable supports.

2. Brief Review of the Prior Art

One form of adjustable support comprises an elongate supporting member and a base including a pair of legs. The supporting member can be moved relative to the base and in one known arrangement, the supporting member includes holes which come into register with holes in the base so that a pin can be inserted through the registering holes to fix the position of the supporting member relative to the base.

It is a problem with such arrangements that there are only a limited number of relative positions of the supporting member and the base. In addition, fixing the supporting member in position relative to the base involves careful adjustment to bring the holes into register and the manipulation of the pin which can be difficult and time-consuming.

SUMMARY OF THE INVENTION

According to a first aspect of the invention, there is provided an adjustable support comprising an elongate supporting member and a base comprising a pair of legs, the legs being pivoted for relative movement between a separated supporting position and a closer inoperative position, the legs in the supporting position holding the member relative to the base, relative movement of the legs to the inoperative position releasing the member for adjusting movement relative to the base.

In this way, the supporting member can be moved to a wide variety of positions relative to the base quickly and easily.

According to a second aspect of the invention, there is provided a trestle comprising a beam and a pair of spaced supporting members depending from the beam, each supporting member being held by a respective base including an associated pair of legs, the legs of each pair being pivoted for relative movement between a separated supporting position and a closer inoperative position, the legs of each pair when in the supporting position holding the associated member relative to the base, relative movement of the legs of each pair to the inoperative position releasing the associated member for adjusting movement relative to the associated base.

The following is a more detailed description of an embodiment of the invention, by way of example, reference being made to the accompanying drawings in which.

DESCRIPTION OF THE PREFERRED EMBODIMENTS

Figure 1:
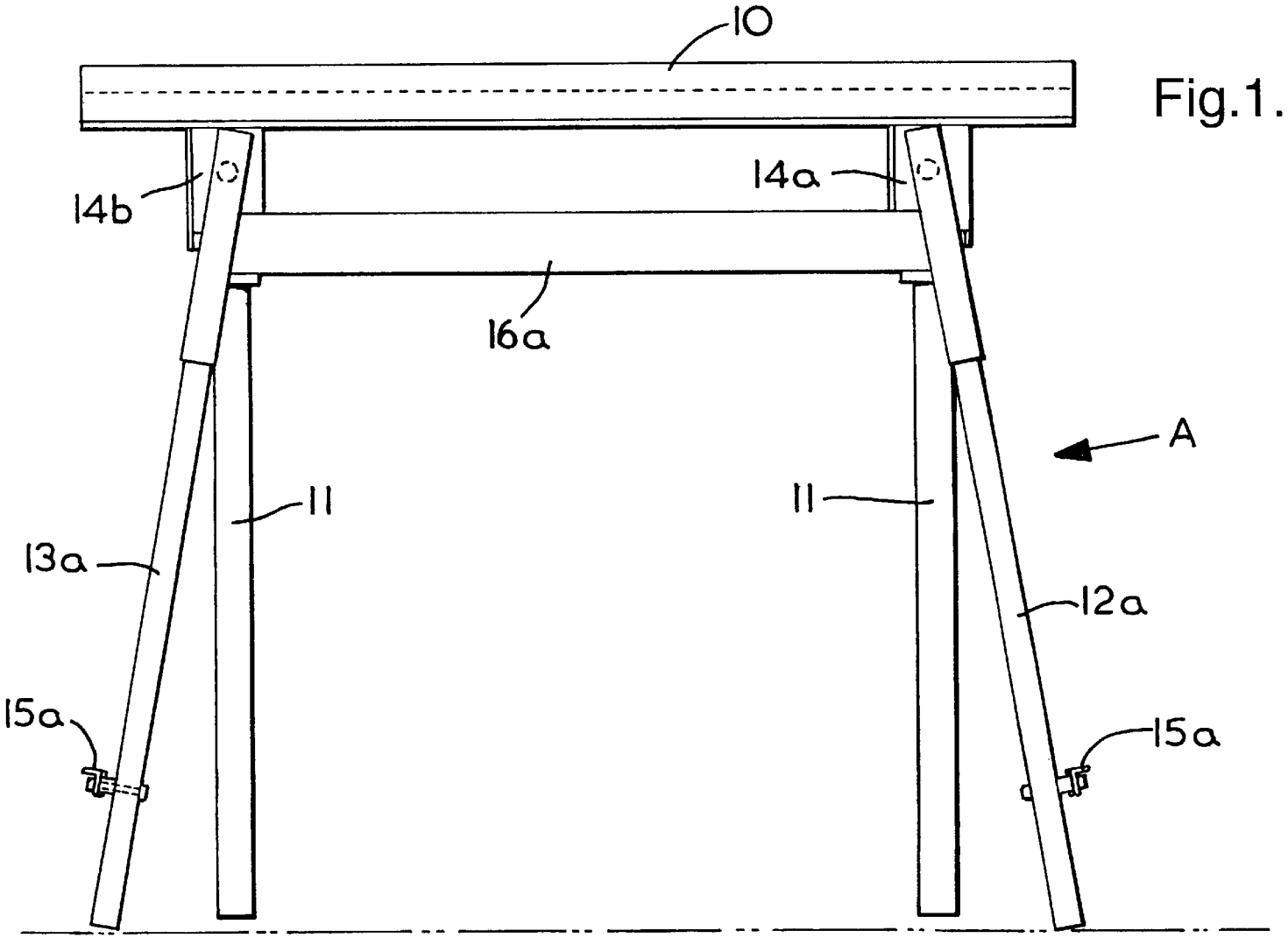
FIG. 1 is a side elevation of a trestle.
Figure 2:
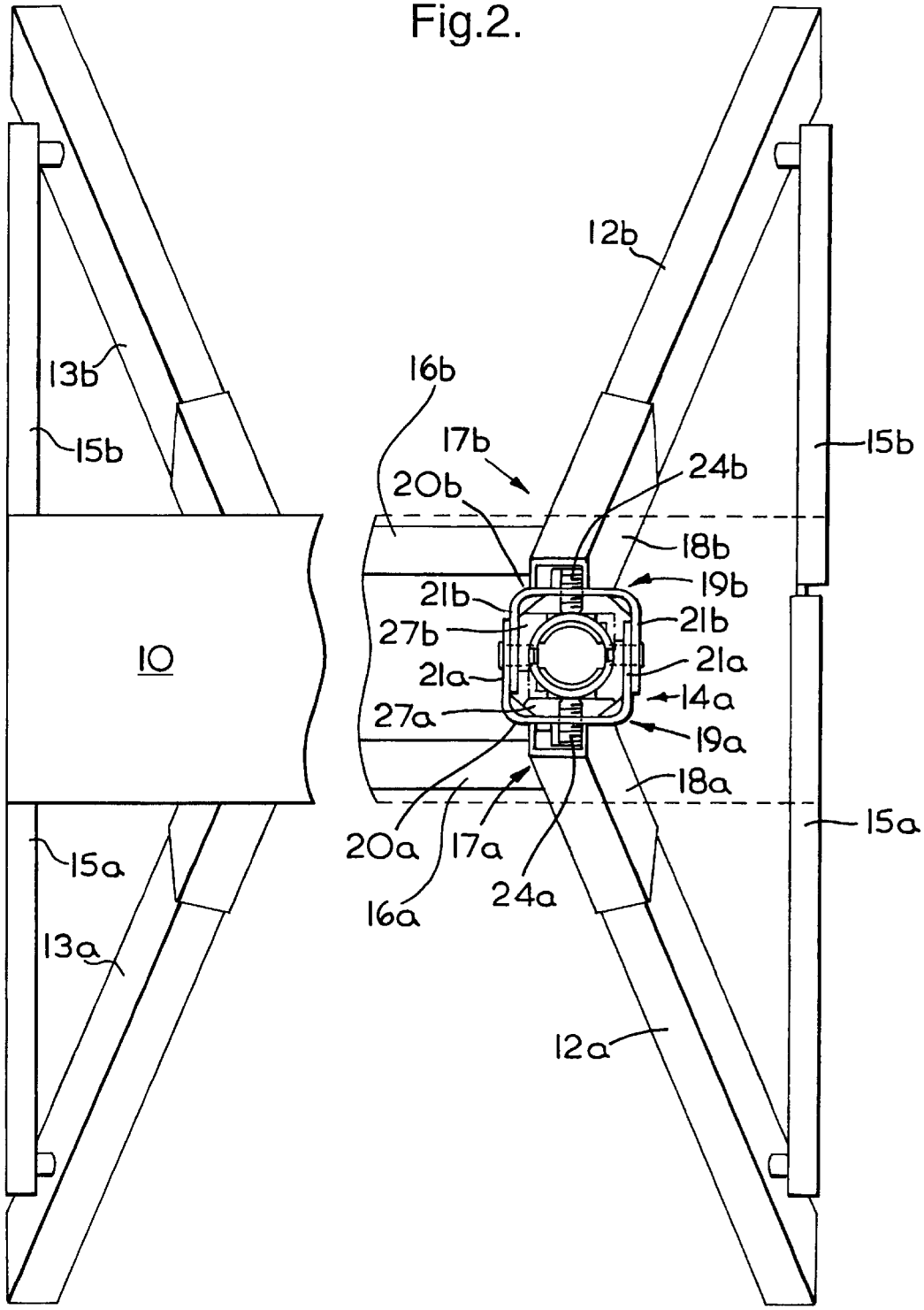
FIG. 2 is a plan view from above of the trestle of FIG. 1 with a beam and poles of the trestle removed on one end.

Referring first to FIGS. 1 and 2, the trestle comprises a beam 10 which may, particularly where the trestle is to be used for sawing applications, be made of wood. The beam 10 carries a pair of spaced elongate supporting poles 11. As seen in FIG. 1, each supporting pole 11 is adjacent an associated end of the beam 10, extends generally vertically and depends from the beam 10.

The beam 10 and the supporting poles 11 are held by a base including generally two pairs of legs 12*a*,12*b*, 13*a*,13*b*. Each pair of legs carries at its upper end a clamping mechanism indicated generally at 14*a*,14*b* and FIGS. 1 and 2.

Figure 3:
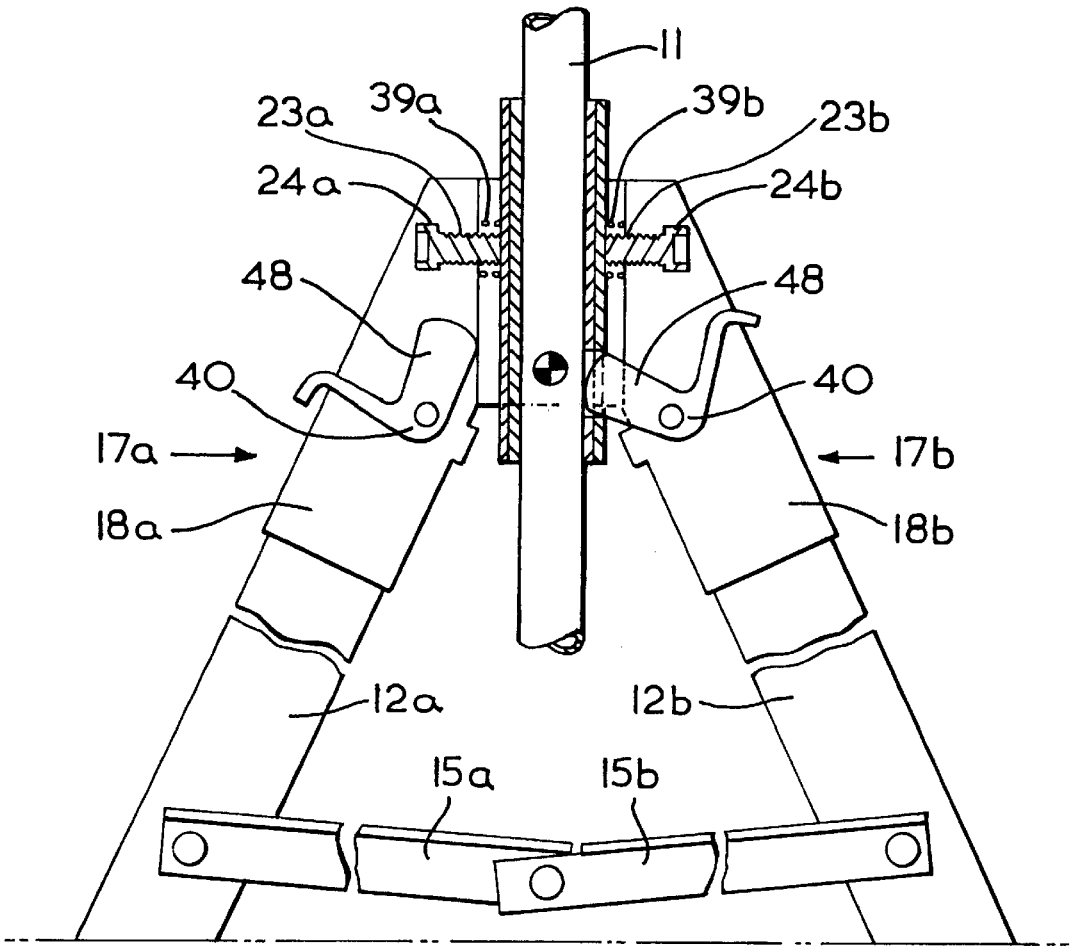
FIG. 3 is a partial end elevation of the trestle of FIGS. 1 and 2.

As seen in FIG. 3 in particular, and as also seen in FIG. 2, each pair of legs 12*a*,12*b*, and 13*a*,13*b* is interconnected by a pair of links 15*a*,15*b*. Each link 15*a*,15*b* is of generally L-shaped cross-section and is pivoted at one end to an associated leg 12*a*,12*b*, and 13*a*,13*b*. The ends of the links 15*a*,15*b* remote from the associated legs 12*a*,12*b*, 13*a*,13*b* are pivoted together in an arrangement which allows the links to go just over-centre, as seen in FIG. 3, and so lock the associated legs 12*a*,12*b*, 13*a*,13*b* in the open supporting position shown in FIGS. 2 and 3.

In addition, as seen in FIGS. 1 and 2, a pair of bars 16*a*,16*b* may interconnect the legs towards their upper ends to space the pairs of legs 12*a*,12*b* and 13*a*,13*b* apart. These bars 16*a*, 16*b* are, however, optional and are, indeed, omitted in FIGS. 3 to 5.

The construction of the pairs of legs 12*a*,12*b*, and 13*a*,13*b* at their upper ends will now be described. It will be appreciated that the arrangement is identical for each pair of legs 12*a*,12*b*, and 13*a*,13*b* and so the arrangement at the ends of the legs 12*a*,12*b* only will be described. It will be understood, however, that the arrangement at the ends of the legs 13*a*,13*b* are identical.

Figure 4:
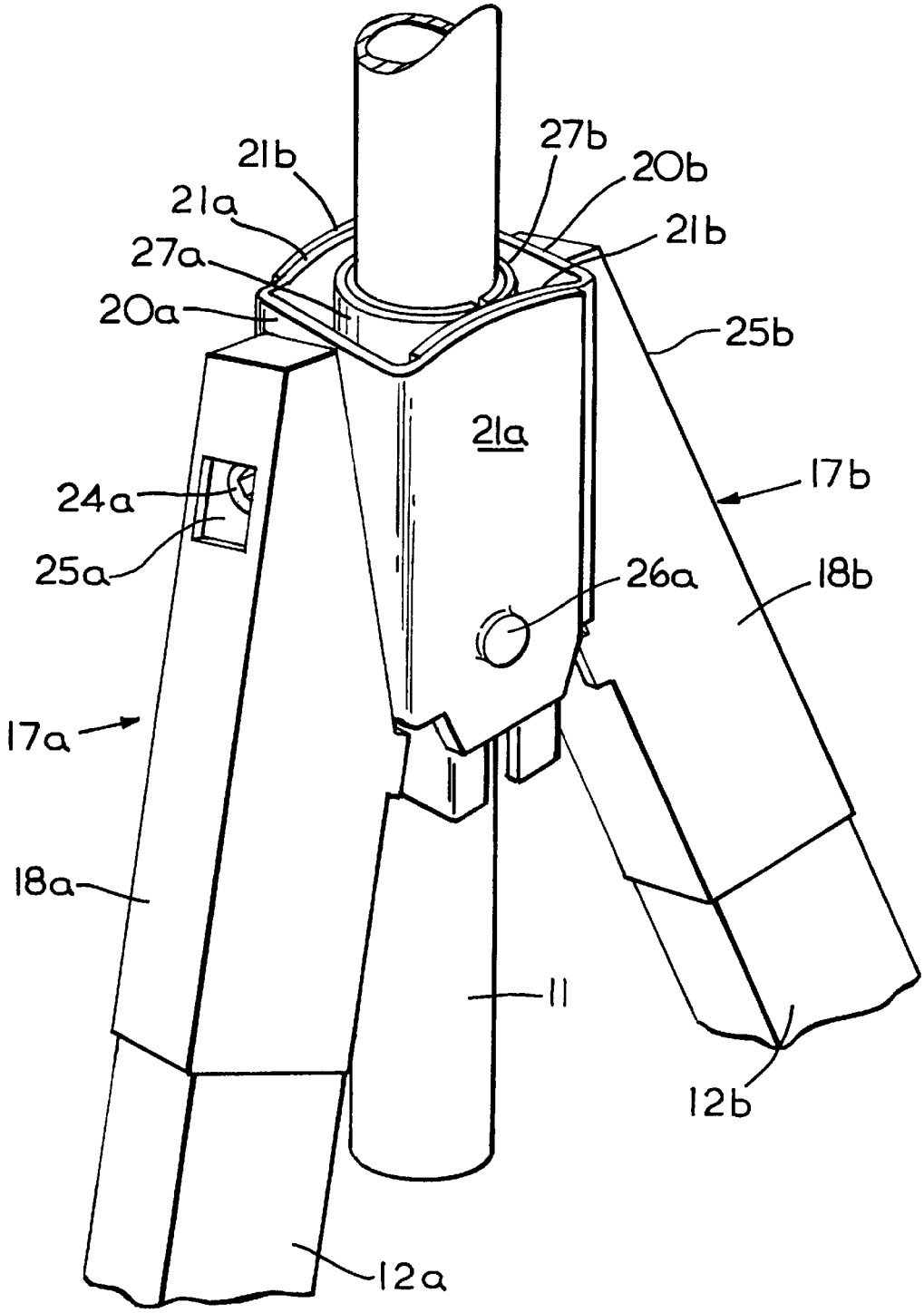
FIG. 4 is a perspective view of part of a pair of legs of the trestle of FIGS. 1 to 3 and showing a clamping mechanism of the trestle engaging a pole of the trestle.
Figure 5:
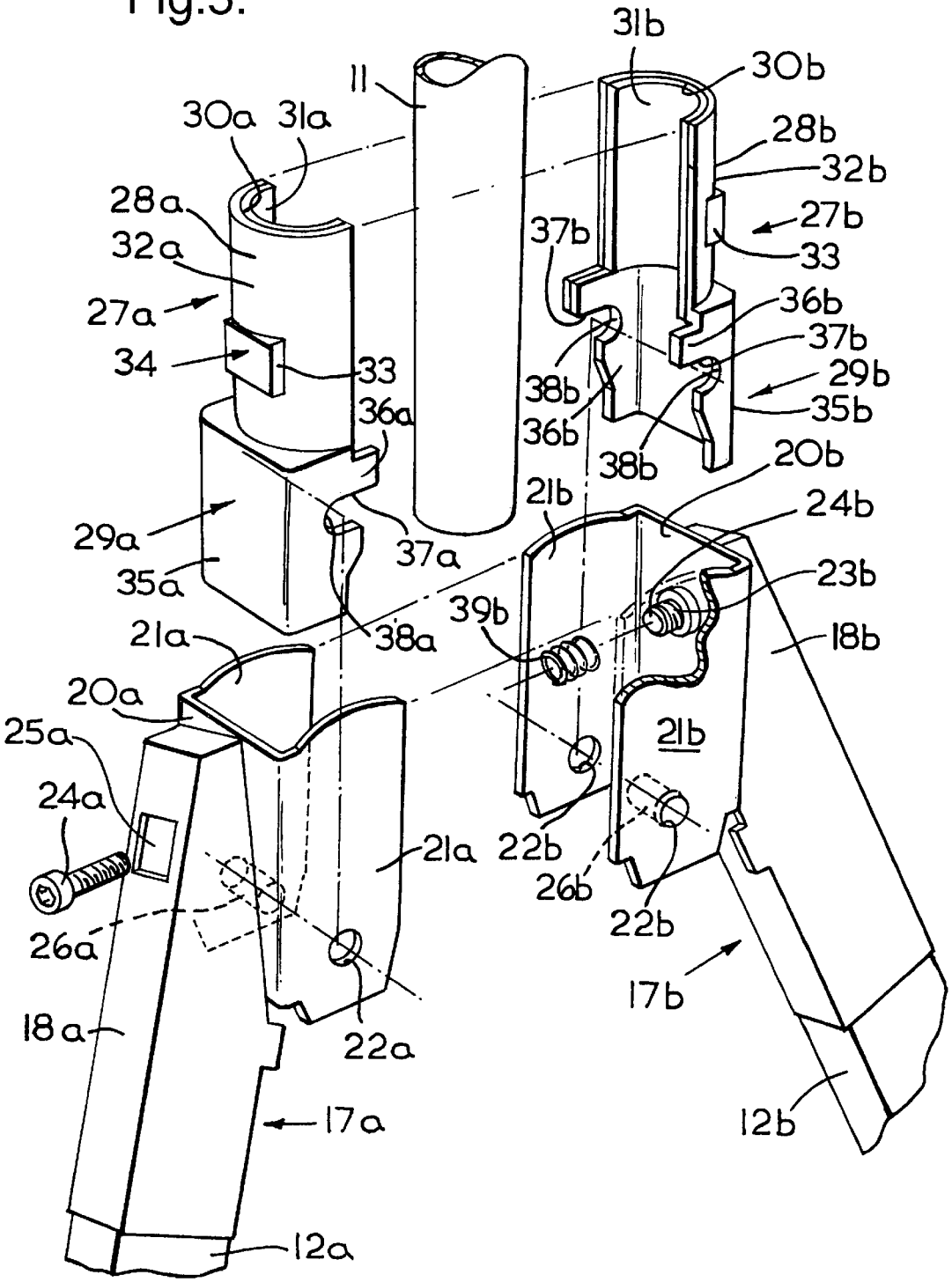
FIG. 5 is a similar view to FIG. 4 but showing the parts exploded.

Referring particularly to FIGS. 3, 4 and 5, each leg includes at its upper end a mounting 17*a*,17*b*. Each mounting 17*a*,17*b* is formed from metal and includes a socket 18*a*,18*b* which receives the remainder of the associated leg 12*a*,12*b*. Each socket 18*a*,18*b* carries a channel-shaped member 19*a*,19*b* including a base 20*a*,20*b* and a pair of spaced parallel side plates 21*a*,21*b*. As seen in FIG. 5, each side plate 21*a*,21*b* has towards its lower end an associated hole 22*a*,22*b* with the holes of each pair of plates 21*a*,21*b* being in register. Each base 20*a*,20*b* includes a threaded hole 23*a*,23*b* through which extends an associated screw 24*a*,24*b* whose head is accessible through a window 25*a*,25*b* provided in the associated socket 18*a*, 18*b*.

As seen particularly in FIG. 4, the two channel-shaped members 19*a*,19*b* embrace one another so that the side plates 21*a* of one channel-shaped member 19*a* lie against the plates 21*b* of the other channel-shaped member 19*b*. When so positioned, pins 26*a*,26*b* can be inserted through the registering hole 23*a*,23*b* of the plates 21*a*,21*b* to hold the channel shaped members 19*a*,19*b* together and so allow the legs 12*a*,12*b* to pivot relative to one another about the pins 26*a*,26*b*.

Each channel-shaped member 19*a*,19*b* embraces an associated clamping member 27*a*,27*b*. Again, only one clamping member 27*a* will be described, it being appreciated that the other clamping member 27*b* is identical.

The clamping member 28*a*,28*b* comprises a semi-cylindrical portion connected to a support mount 29*a*,29*b*. The semi-cylindrical portion has an interior curved clamping surface 30*a*, 30*b* that is lined with an elastomeric material 31*a*,31*b* such as rubber. The exterior surface 32*a*,32*b* of the semi-cylindrical portion carries a boss 33 with a flat surface 34 which co-operates with an associated one of the screws 24*a*,24*b* in a manner to be described below. As seen in FIG.

5, the diameter of the clamping surfaces 30*a*,30*b* are equal to the outside diameter of the associated pole 11.

The support mounting 29*a*,29*b* is of generally U-shaped cross-section with a rear 35*a*,35*b* and two parallel projecting side walls 36*a*,36*b*. Each side wall 36*a*,36*b* includes an elongate slot 37*a*,37*b* terminating in a semi-circular end 38*a*,38*b*. Below the slots 38*a*, 38*b*, the side walls 36*a*,36*b* are cut away.

Each clamping member 27*a*,27*b* is carried by the associated channel-shaped member 19*a*,19*b* with the inwardly projecting ends of the pins 26*a*,26*b* extending into the associated slots 37*a*,37*b*. In this way, the position of each clamping member 27*a*,27*b* is fixed vertically but the clamping member 27*a*, 27*b* has a degree of horizontal movement by relative movement of the slots 37*a*,37*b* and the pins 26*a*,26*b*. The screws 24*a*,24*b* bear against the associated bosses 33 and springs 39*a*,39*b* are provided acting between the bases 20*a*,20*b* respectively and the associated bosses 33. The effect of this is to force the two clamping members 27*a*,27*b* towards one another so that they embrace the associated pole 11 loosely so preventing the associated pole 11 sliding freely between the clamping members 27*a*,27*b* while allowing its position to be manually adjusted.

The function of the screws 24*a*,24*b* is to allow the relative positions of the clamping members 27*a*,27*b* to be adjusted to accommodate variations in the diameter of the poles 11. Screwing a screw 24*a*,24*b* into the associated base 20*a*,20*b* so pressing on the associated boss 33. This pushes the associated clamping member 27*a*,27*b* inwardly so increasing the clamping force both when the clamping members 27*a*,27*b* are clamped and when they are released. Opposite rotation of a screw 24*a*,24*b* reduces the clamping pressures.

Such relative movement between the clamping members 27*a*,27*b* and the associated channel-shaped members 19*a*, 19*b* is accommodated by the relative movement between the slots 37*a*,37*b* and the pins 26*a*,26*b* referred to above.

In use, the arrangement is such that when the legs are in the separated supporting position shown in FIGS. 1, 2 and 3, the mountings 17*a*,17*b* force the clamping members 27*a*, 27*b* against the associated pole 11 to prevent relative movement between the pole 11 and the legs 12*a*,12*b*. The pole 11, and thus the associated part of the beam 10, is thus fixed in position relative to the legs 12*a*,12*b*. This is the position shown in FIG. 4.

As shown in FIG. 3, each socket 18*a*,18*b* may carry an associated cam locking lever 40 which, when pivoted from the inoperative position shown on the left-hand side of FIG. 3 to the operative position shown on the right-hand side of FIG. 3, engages the associated pole such that any tendency for continued downward movement by the associated pole 11 wedges a cam 48 of the locking lever 40 even more firmly against the pole 11. This is an optional feature but can be useful when the beam 10 is to carry very high loads.

The poles 11 are released by lifting the links 15*a*,15*b* of the two pairs of legs 12*a*,12*b* from the over-centre position shown in FIG. 3 to allow the legs to be pivoted about the pins 25*a*,25*b* towards one another. In this way, the legs move from their separated supporting position to a closed inoperative position. As a result of such movement, the mountings 17*a*,17*b* no longer bear tightly against the clamping members 27*a*,27*b* and so these are released from clamping engagement with the associated pole 11. This allows the pole to be adjusted relative to the legs 12*a*,12*b* or 13*a*,13*b* to a different position before the legs are re-separated to cause the mountings 17*a*,17*b* to press the clamping members 27*a*,27*b* against the associated pole 11.

Figure 6:
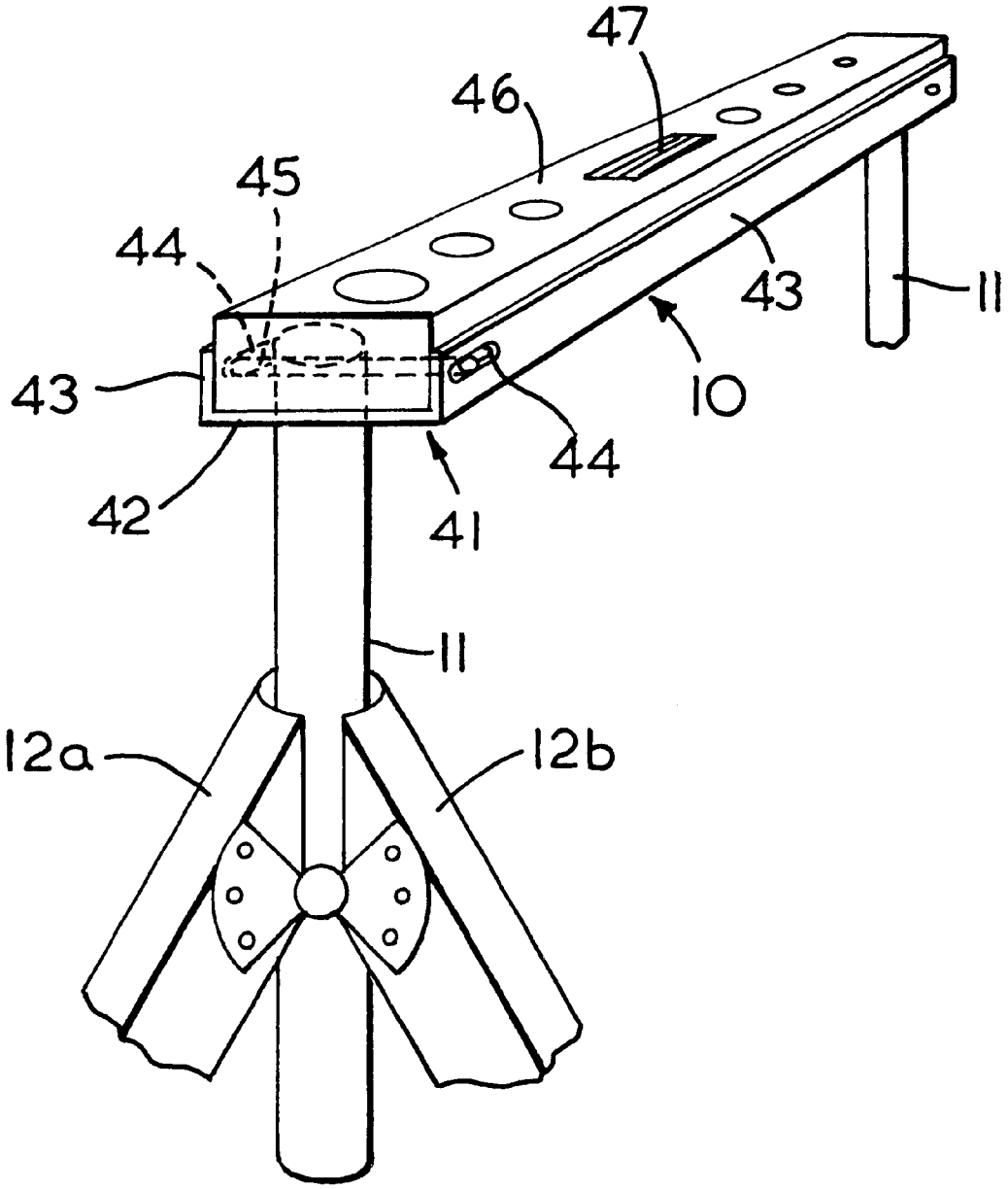
FIG. 6 is a schematic view of an alternative form of beam for use in the trestle of FIGS. 1 to 5.

FIG. 6 shows schematically an alternative arrangement of the beam. In this Figure, parts common to FIGS. 1 to 5 and FIG. 6 are given the same reference numerals and will not be described in detail. In addition, in FIG. 6, the legs 12*a*,12*b*, and 13*a*,13*b* and the clamping mechanisms 14*a*, 14*b* are shown only schematically or not at all.

In this alternative arrangement, the beam 10 includes an upwardly opening U-shaped channel member 41 with a base 42 and upstanding side walls 43. The side walls include a pair of registering slots 44 that receive respective ends of a rod 45 whose centre extends through the associated pole 11 to connect the pole 11 to the beam 10. This allows relative pivotal movement between the poles 11 and the beam 10 and thus allows the end of one pole 11 to be raised to the level of the other pole 11.

As seen, in this arrangement, the U-shape channel member 41 may carry a timber beam 46 which may include a spirit level 47 to allow the whole beam 10 to be level.

It will be appreciated that there are a number of variations that can be made to the arrangement described above with reference to the drawings. First, although a trestle has been described above, the clamping arrangement can be used in any situation where an elongate supporting member such as a pole is movable relatively to a base comprising a pair of legs which can be opened and closed to operate a clamping mechanism. The elastomeric material 31 is optional as are the screws 24*a*,24*b* and the springs 39*a*,39*b*.

The use of separate clamping members and mountings is also optional; the clamping members could be mounted directly at the ends of the legs.

What is claimed is:

1. A trestle comprising a beam and a pair of spaced supporting members depending from the beam, each supporting member being clamped by a respective base which includes an associated pair of legs and a clamping mechanism arranged with the legs, the legs of each pair being pivotable for relative movement between a separated supporting position and a closer inoperative position, wherein relative movement of the legs of each pair to the supporting position forces the clamping mechanism against the associated supporting member and fixes the position of the supporting member relative to the associated base and relative movement of the legs of each pair to the inoperative position releases the clamping mechanism from clamping engagement with the associated supporting member and allows the position of the supporting member to be adjusted along the supporting member relative to the associated base.

2. A trestle according to claim 1 wherein the connection between said supporting members and said beam allows relative angular movement between the beam and each member.

3. A trestle according to claim 1 wherein each clamping mechanism includes two clamping parts embracing respective opposite sides of the associated member, the clamping parts being forced against said associated member to hold the member relative to the associated base when the legs are in the separated supporting position.

4. A trestle according to claim 3 wherein each member is of circular cross-section, each clamping part having a concave clamping surface that fits around the associated member when the legs are in the separated supporting position.

5. A trestle according to claim 4 wherein each clamping surface is lined with an elastomeric material.

6. A trestle according to claim 3 wherein each leg includes a part movable therewith that forces an associated clamping part against the associated member when the legs are in the separated supporting position.

7. A trestle according to claim 6 wherein each part includes a connecting portion for connecting the part to the associated leg and a channel shaped portion which embraces the associated clamping part when the legs are in the separated supporting position.

8. A trestle according to claim 7 wherein the channel portions of each part are pivotally connected together to provide a pivot for the associated legs.

9. A trestle according to claim 3 wherein adjusting means are provided for adjusting the position of the clamping parts relative to the associated legs and so adjust the clamping pressure applied to the associated member when the legs are in the separated supporting position.

10. A trestle according to claim 3 wherein the clamping parts are urged together by spring means to embrace the associated member with sufficient force to prevent relative movement between the member and the associated clamping parts under the weight of the member alone with the legs in the inoperative position but permit manual movement of the member relative to the associated clamping parts with the legs so positioned.

11. A trestle according to claim 3 wherein locking means are provided to lock the member to the associated base on movement of the member relative to the base with the associated legs in the separated supporting position.

12. A trestle according to claim 11 wherein the locking means comprises an eccentrically mounted rotatable cam movable between the member and an associated leg, said relative movement increasing wedging the cam between the member and the leg to prevent said movement.

13. An adjustable support comprising an elongate supporting member and a base comprising a pair of legs, the legs being pivoted for relative movement between a separated supporting position and a closer inoperative position, the legs in the supporting position holding the member relative to the base, relative movement of the legs to the inoperative position releasing the member for adjusting movement relative to the base, wherein each pair of legs carries a clamping mechanism, the legs in the supporting position clamping the member to hold the member, movement of the legs to the inoperative position releasing the clamping mechanism, wherein each clamping mechanism includes two clamping parts embracing respective opposite sides of the associated member to hold the member relative to the associated base when the legs are in the separated supporting position, and wherein the clamping parts are urged together by spring means to embrace the associated member with sufficient force to prevent relative movement between the member and the associated clamping parts under the weight of the member alone with the legs in the inoperative position but permit manual movement of the member relative to the associated clamping parts with the legs so positioned.

14. An adjustable support comprising an elongate supporting member and a base comprising a pair of legs, the legs being pivoted for relative movement between a separated supporting position and a closer inoperative position, the legs in the supporting position holding the member relative to the base, relative movement of the legs to the inoperative position releasing the member for adjusting movement relative to the base, wherein each pair of legs carries a clamping mechanism, the legs in the supporting position clamping the member to hold the member, movement of the legs to the inoperative position releasing the clamping mechanism, wherein each clamping mechanism includes two clamping parts embracing respective opposite sides of the associated member to hold the member relative to the associated base when the legs are in the separated supporting position, wherein locking means are provided to lock the member to the associated base on movement of the member relative to the base with the associated legs in the separated supporting position, and wherein the locking means comprises an eccentrically mounted rotatable cam movable between the member and an associated leg, said relative movement increasingly wedging the cam between the member and the leg to prevent said movement.

* * * * *